US008864137B2

(12) United States Patent
Ritter et al.

(10) Patent No.: US 8,864,137 B2
(45) Date of Patent: Oct. 21, 2014

(54) ACTION GAME APPARATUS AND METHOD

(75) Inventors: Janice Ritter, Redondo Beach, CA (US); Rawn Trinidad, San Pedro, CA (US); Stephen Lau, Torrance, CA (US)

(73) Assignee: Mattel, Inc., El Segundo, CA (US)

( * ) Notice: Subject to any disclaimer, the term of this patent is extended or adjusted under 35 U.S.C. 154(b) by 462 days.

(21) Appl. No.: 13/214,607

(22) Filed: Aug. 22, 2011

(65) Prior Publication Data

US 2012/0049445 A1 Mar. 1, 2012

Related U.S. Application Data

(60) Provisional application No. 61/377,681, filed on Aug. 27, 2010.

(51) Int. Cl.

| | |
|---|---|
| ***A63F 7/00*** | (2006.01) |
| ***A63F 9/30*** | (2006.01) |
| *A63F 11/00* | (2006.01) |
| *A63F 7/24* | (2006.01) |

(52) U.S. Cl.

CPC ..... *A63F 9/30* (2013.01); *A63F 2011/0058* (2013.01); *A63F 2011/0032* (2013.01); *A63F 7/249* (2013.01); *A63F 2011/0009* (2013.01); *A63F 11/0051* (2013.01); *A63F 2250/486* (2013.01)

USPC ..... 273/440; 273/447; 273/459

(58) Field of Classification Search

USPC ..... 273/447, 445, 459, 460

See application file for complete search history.

(56) References Cited

U.S. PATENT DOCUMENTS

| | | | | |
|---|---|---|---|---|
| 3,358,998 | A | 12/1967 | Goldfarb | |
| 3,391,934 | A | 7/1968 | Ryan et al. | |
| 3,565,425 | A | 2/1971 | Breslow | |
| 3,565,432 | A | 2/1971 | Reiner et al. | |
| 3,578,319 | A | 5/1971 | Kohner et al. | |
| 3,582,075 | A * | 6/1971 | Glass et al. | 273/317 |
| 3,583,702 | A | 6/1971 | Glass et al. | |
| 3,669,451 | A | 6/1972 | Welbourn | |
| 3,708,168 | A | 1/1973 | Strader et al. | |
| 3,710,455 | A | 1/1973 | Liversidge et al. | |
| 3,973,774 | A | 8/1976 | Breslow et al. | |
| 4,118,026 | A * | 10/1978 | Todokoro | 273/447 |
| 4,119,312 | A | 10/1978 | Todokoro | |
| 4,177,992 | A * | 12/1979 | Todokoro | 273/357 |

(Continued)

FOREIGN PATENT DOCUMENTS

| | | | |
|---|---|---|---|
| EP | 824945 | A1 | 2/1998 |
| GB | 2033762 | A | 5/1980 |
| GB | 2121306 | A | 12/1983 |
| JP | 2000084233 | A | 3/2000 |

OTHER PUBLICATIONS

Hasbro-40850100-MB-Konig-Kokos: Amazon.de: Spielzeug, http://www.amazon.de/Hasbro-40850100-MB-Konig-Kokos/dp/BOOOM . . . , Jul. 6, 2011, (6 pages) (printed Jul. 6, 2011).

(Continued)

*Primary Examiner* — Raleigh W Chiu

(74) *Attorney, Agent, or Firm* — Edell, Shapiro & Finnan LLC

(57) ABSTRACT

An action game apparatus and method are disclosed. The apparatus is useable to play an action game including a launching device and a collection device with an indicator that signals when a predetermined quantity of game pieces have been collected.

15 Claims, 8 Drawing Sheets

(56) References Cited

U.S. PATENT DOCUMENTS

| | | | | |
|---|---|---|---|---|
| 4,229,003 | A | 10/1980 | Shimizu | |
| 4,244,568 | A | 1/1981 | Ferris et al. | |
| 4,266,767 | A | 5/1981 | Spring | |
| 4,297,807 | A | 11/1981 | Buettner | |
| 4,306,717 | A | 12/1981 | Todokoro | |
| 4,412,682 | A | 11/1983 | Rehkemper et al. | |
| 4,469,327 | A | 9/1984 | Ulrich et al. | |
| 4,583,743 | A | 4/1986 | Macek | |
| 4,650,192 | A | 3/1987 | Todokoro | |
| 4,714,249 | A | 12/1987 | Barlow | |
| 4,749,195 | A | 6/1988 | Lee | |
| 4,802,668 | A | 2/1989 | Kobayashi | |
| 4,813,670 | A | 3/1989 | Mizunuma | |
| 4,826,160 | A | 5/1989 | Kobayashi | |
| 4,826,176 | A * | 5/1989 | Kobayashi | 273/354 |
| 4,863,164 | A | 9/1989 | Mizunuma | |
| 4,900,026 | A | 2/1990 | Kulesza et al. | |
| 4,961,580 | A | 10/1990 | Yoe et al. | |
| 5,028,047 | A | 7/1991 | Lee et al. | |
| 5,052,967 | A | 10/1991 | Slatter et al. | |
| 5,102,148 | A | 4/1992 | Mizunuma | |
| 5,207,793 | A | 5/1993 | Brand et al. | |
| 5,342,064 | A | 8/1994 | Williamson et al. | |
| 5,344,156 | A * | 9/1994 | Levin | 273/355 |
| 5,458,342 | A | 10/1995 | Hernandez | |
| 5,566,949 | A | 10/1996 | Gorden | |
| 5,571,267 | A | 11/1996 | Yokoi et al. | |
| 5,632,490 | A | 5/1997 | Brown | |
| 5,657,995 | A | 8/1997 | Howard | |
| 5,702,108 | A | 12/1997 | Todokoro | |
| 5,752,704 | A * | 5/1998 | Todokoro | 273/447 |
| 5,947,478 | A | 9/1999 | Kwan et al. | |
| 6,099,381 | A | 8/2000 | Sodeshima | |
| 7,169,010 | B1 | 1/2007 | Espinosa, Jr. | |
| 8,109,518 | B2 * | 2/2012 | Blagg et al. | 273/368 |
| 8,444,151 | B2 * | 5/2013 | Moran et al. | 273/450 |
| 2002/0094753 | A1 | 7/2002 | Campos et al. | |
| 2004/0251631 | A1 | 12/2004 | Chou | |
| 2009/0224481 | A1 | 9/2009 | Mukasa et al. | |

OTHER PUBLICATIONS

Hasbro 40850100-MB Coconut: Amazon.de. toys, http://translate.googleusercontent.com/translate_c?hl=en&prev=/search? . . . , Jul. 6, 2011, (2 pages) (printed Jul. 6, 2011).

* cited by examiner

ACTION GAME APPARATUS AND METHOD

CROSS REFERENCE TO RELATION APPLICATIONS

This application claims priority to U.S. Provisional Patent Application No. 61/377,681, filed Aug. 27, 2010 and entitled "Action Game Apparatus and Method," the entire disclosure of which is hereby incorporated by reference in its entirety.

FIELD OF THE INVENTION

The present invention relates generally to an action game apparatus and method, and more specifically, to an action game including a launching device and a collection device with an indicator that signals when a predetermined amount of game pieces has been collected.

BACKGROUND

Action games have long provided hours of fun and entertainment for children, since children enjoy toys that spin, bounce, vibrate, or otherwise move. In particular, toys or games that involve launching game pieces into the air and/or capturing game pieces have been popular with children. In these types of games, game play is terminated when all the game pieces are ejected by the launching device, or when a predetermined number of game pieces is captured by a player. To determine a winner, the captured game pieces are not counted or differentiated by the game components, but through manual counting by the players. This poses a problem for young children who are unable to count the game pieces to determine the winner of the match.

Thus, it would be desirable to provide a game apparatus including a game piece collection device capable of indicating to a user that a predetermined amount of game pieces (e.g., a match ending amount of game pieces) has been captured.

SUMMARY

The present invention is directed toward a game including a launching device, a collection device, and a plurality of game pieces. The launching device includes a cavity for holding game pieces and a propulsion mechanism operable to propel one or more game pieces out from the cavity. The propulsion mechanism includes a propelling member selectively engaged by a player that generates force sufficient to propel game pieces. Specifically, a player engages an engagement member to generate a force sufficient to propel a game piece out from the cavity and onto a playing surface (e.g., a floor or table). The collection device includes a chamber for receiving the game pieces and an indicator mechanism operable to signal to the player when a predetermined number of game pieces is present within the chamber. The collection device includes a portal configured such that a predetermined level of force is necessary to permit the passage of a game piece into or out of the chamber. With this configuration, the collection device stores the game pieces as they are collected, and the indicator mechanism signals to the player that a predetermined number of game pieces has been captured (e.g., the indicator mechanism indicates that the player has won the match).

In an exemplary operation, a player fills the cavity of the launching device with a plurality of game pieces, and engages the propulsion mechanism to propel the game pieces from the launching device and onto the playing surface. The game pieces, now scattered about the playing surface, are then collected via the collection device. Specifically, striking down on a game piece with the collection device urges the game piece through the portal and into the chamber. Once the chamber becomes filled with a predetermined number of game pieces, the indicator mechanism automatically signals to the player that the predetermined number of game pieces has been collected.

BRIEF DESCRIPTION OF THE DRAWINGS

Like reference numerals have been used to identify like elements throughout this disclosure.

DETAILED DESCRIPTION

Figure 1:
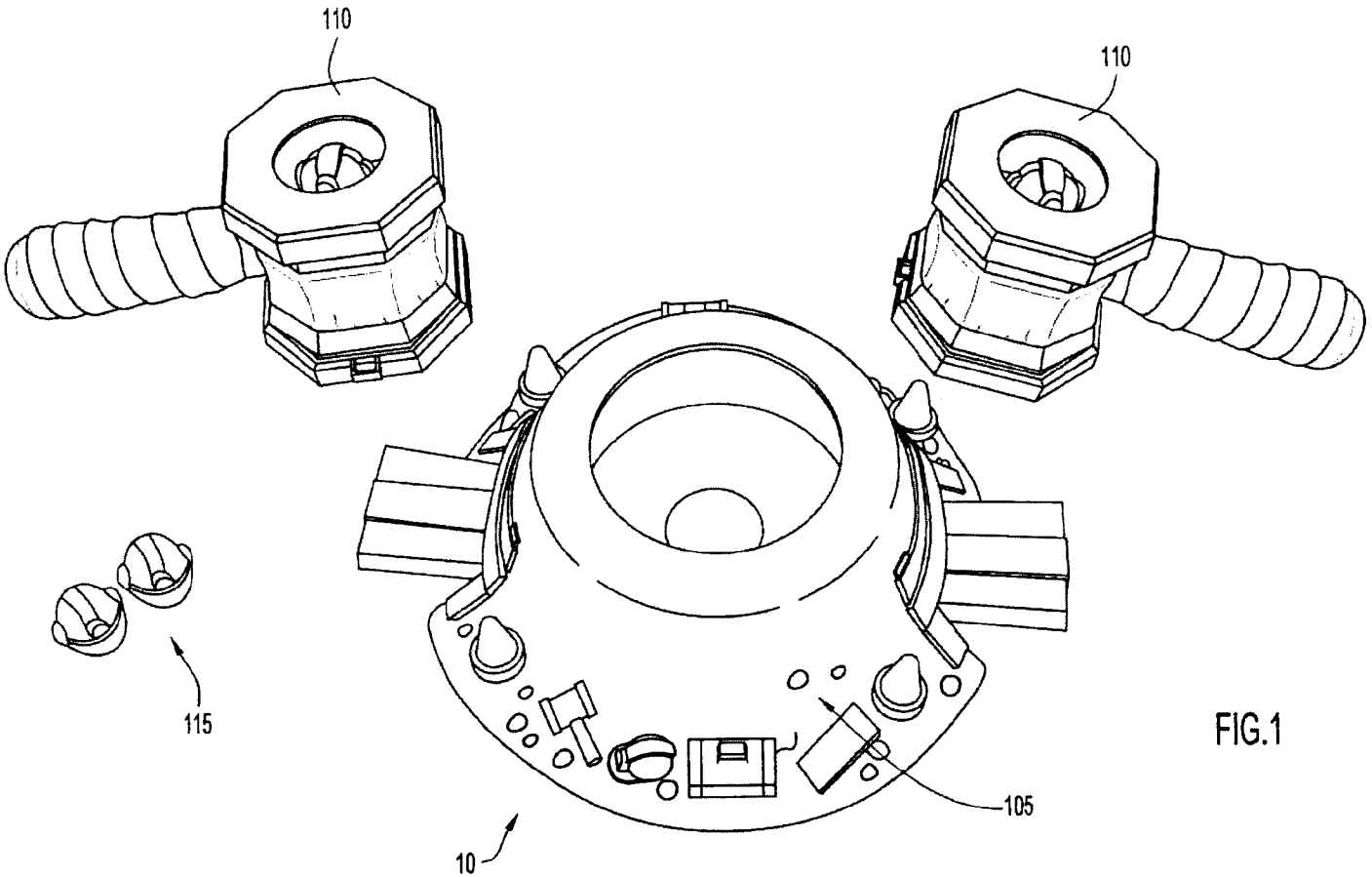
FIG. 1 illustrates a perspective view of an action game apparatus in accordance with an embodiment of the invention.
Figure 2A:
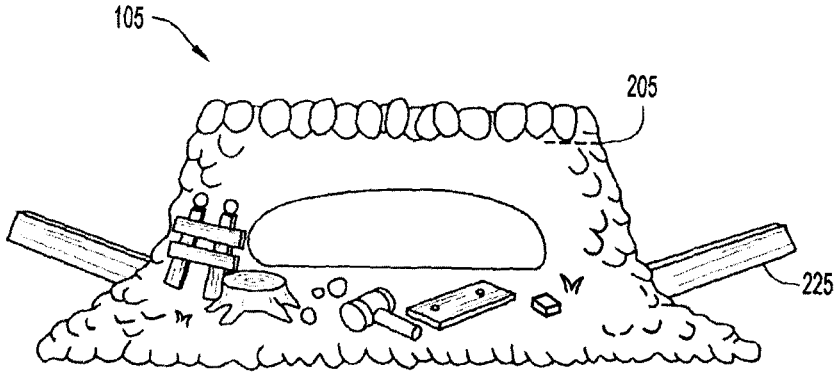
FIG. 2A illustrates a side view of a launching device in accordance with an embodiment of the present invention.
Figure 2C:
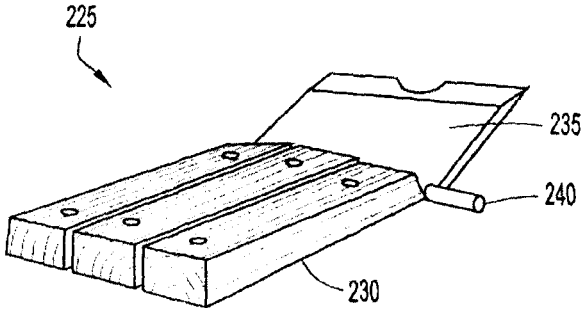
FIG. 2C illustrates a side perspective view of an engagement member in accordance with an embodiment of the present invention.
Figure 2B:
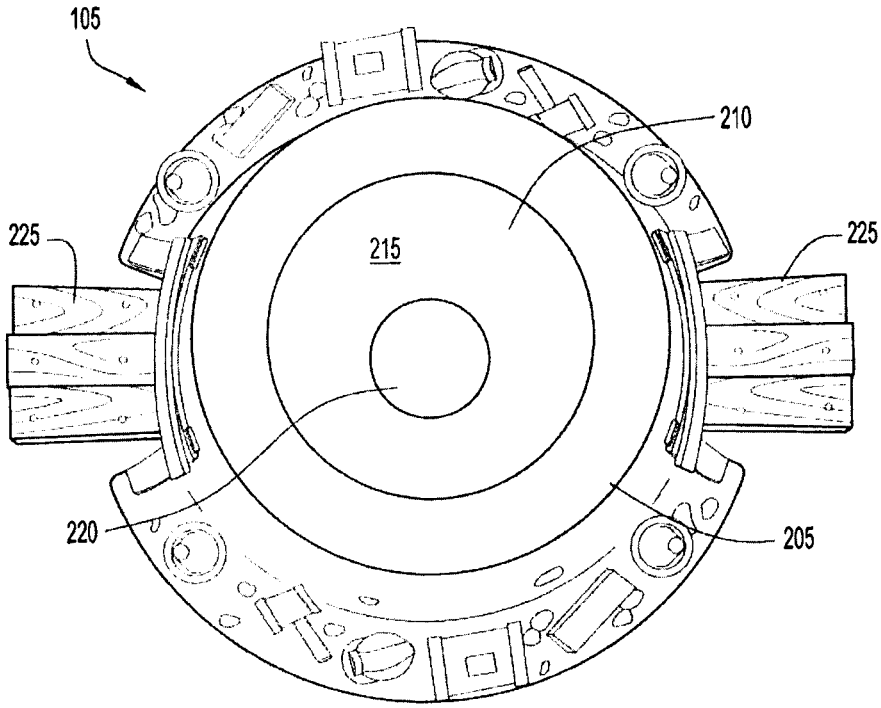
FIG. 2B illustrates a top plan view of the launching device shown in FIG. 1.

FIG. 1 illustrates a perspective view of the play set or action game apparatus in accordance with an embodiment of the invention. As illustrated, the action game apparatus 10 includes a launching device 105, a collection device 110, and one or more game pieces 115. The launching device 105 is configured to propel game pieces onto a playing surface (e.g., the supporting surface of the launching device such as a table or floor). Referring to FIGS. 2A-2C, the launching device 105 includes a body 205 with a recessed cavity 210 (see FIG. 2B). The cavity 210, defined by a side wall and a floor 215, is configured to receive one or more game pieces 115. In an embodiment, the floor 215 is angled downward in the inboard direction (i.e., the floor inclines from the floor perimeter toward the floor center axis) to direct game pieces toward the center of the cavity 210.

The launching device 105 includes a propulsion mechanism operable to eject a game piece 115 from the body cavity 210. The propulsion mechanism may include an articulating or propelling member in communication with an engagement member such that engaging the engagement member causes the propelling member to contact a game piece and drive it upward. In the illustrated embodiment, the propelling member is a telescoping boss 220 centrally disposed within the cavity 210 (e.g., the boss may be coaxial with the cavity floor). The boss 220 moves from a first, retracted position to a second, extended position relative to the floor. In the retracted position, the boss 220 may be generally flush with the floor 215 of the cavity 210. In the extended position, the boss 220 may extend distally from the floor 215, protruding above the floor surface.

The engagement member is operable to selectively activate the telescoping boss 220, driving it from its first position to its second position, and vice versa. An embodiment of the engagement member 225 is illustrated in FIG. 2C. As shown, the engagement member may be a lever 225 including a paddle or strike portion 230, a trigger or lift portion 235 extending distally from the forward end of the paddle portion and disposed an acute angle with respect to the paddle portion, and a pivot pins 240 disposed proximate the intersection of the paddle and trigger portions 230, 235, each pin 240 extending outwardly from the lever 225 along the sides of the lever. When coupled to the body 205, the paddle portion 230 extends outward from the body 205 such that it is exposed to the player, enabling the player to contact the paddle portion 230 (e.g., by striking it with the player's hand or the collection device 110). The trigger portion 235, moreover, is positioned within the body 205 below the cavity floor 215 and in communication with (e.g., in contact with) the boss 220.

In operation, the trigger portion 235 is situated to lift the boss 220 upon the downward pivot of the paddle portion 230. Specifically, movement of the paddle portion 230 downward pivots the trigger portion 235 upward. Consequently, striking the paddle portion 230 pivots the lever 225 about pivot pins 240, which, in turn, drives the boss 220 from its first, retracted position to its second, extended position. As the boss 220 extends, it contacts game pieces disposed along its travel path in the cavity 210. Consequently, the boss 220 transfers its driving force to any game pieces 115 situated in proximity to the boss 220. The amount of upward force applied to the game pieces 115 is generally proportional to the amount of striking force applied to the lever 225 by the player.

The launching device 105 may include any number of engagement members disposed at predetermined positions about the body 205. In the embodiment illustrated, the launching device 110 includes first and second engagement members disposed at radial positions about the body 205 such that the first engagement member is generally diametrically opposed from the second engagement member.

With this configuration, when game pieces 115 are placed on the floor 215 of the cavity 210, the game pieces 115 are directed toward the boss 220 (since the floor inclines toward the boss). Striking the lever 225 with the collection device 110 drives the boss 220 upward with a force sufficient to apply upward (e.g., vertical) thrust to one or more of the game pieces 115. That is, striking the lever 225 with a predetermined amount of force will propel the game pieces 115 upward and/or outward such that the game pieces 115 exit the cavity 210 and land, scattered about the playing surface surrounding the launching device 105. The upper rim of the body 205 has an inwardly directed orientation that defines the opening at the top of the body 205 through which the game pieces 115 move. The upper rim makes it slightly more difficult for the game pieces 115 to exit the body 205.

Figure 3A:
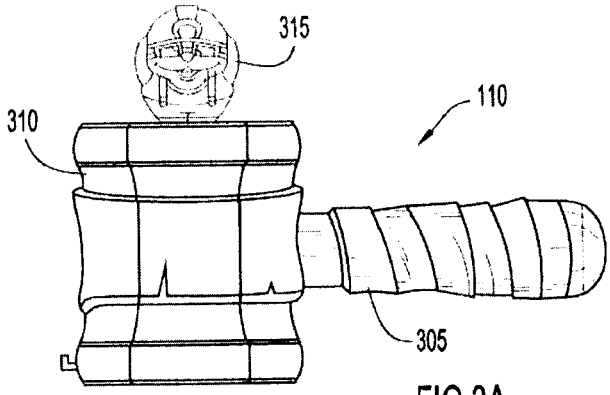
FIG. 3A illustrates a side view of a collection device in accordance with an embodiment of the present invention.
Figure 3B:
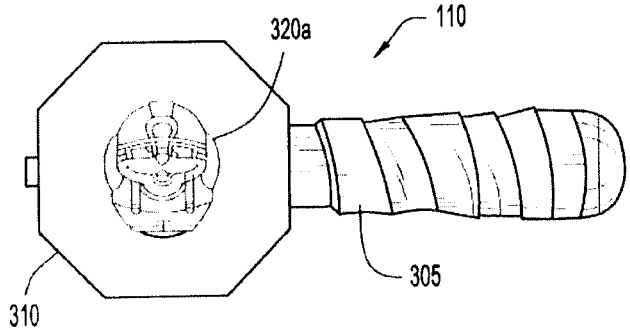
FIG. 3B illustrates a top view of the collection device shown in FIG. 3A.
Figure 3C:
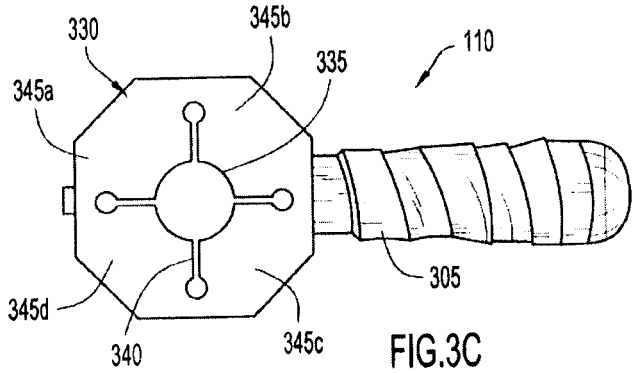
FIG. 3C illustrates a bottom view of the collection device shown in FIG. 3A.

Referring to FIGS. 3A-3C, the collection device 110 may be generally stylized as a hammer. The collection device 110 includes a gripping portion or handle 305, a capture portion or head 310, and an indicator mechanism 315 mounted on the head portion 310. The handle 305 may be a generally elongated bar that enables a user to grasp and maneuver the collection device 110. The head 310 is configured to capture and store a plurality of game pieces 115. The head 310 may be in the form of a generally hollow cylinder having an open first (upper) or indicator side 320A (see FIG. 3B) and an open second (lower) or striking side 320B (see FIG. 4A). The head 310 is generally hollow, defining an internal storage chamber 405 (see FIG. 4A) operable to store one or more game pieces 115 (see FIG. 4B).

The second side 320B of the head portion 310 is configured to selectively permit the passage of game pieces into and out of the storage chamber 405. Referring back to FIG. 3C, the second side 320B of the head portion 310 includes a membrane 330. In one embodiment, the membrane 330 is a cap that is selectively removable from the second head side 320B. The membrane 330 is formed of flexible and/or resilient material such as polyethylene or polyvinyl chloride (PVC). The membrane 330 includes a central opening 335 (e.g., a generally circular hole) generally aligned with the central axis of the head portion 310. The opening 335 may include dimensions (e.g., a diameter) similar to the dimensions (e.g., the diameter) of a game piece 115.

A plurality of radially extending slits or cuts extend outwardly from the membrane opening 335 to form a plurality of flexible membrane flaps. By way of example, the membrane 330 may include four slits 340 that divide the membrane into four quadrants, defining four membrane flaps 345A-345D. Each flap 345A-345D flexes; consequently the flaps cooperate to permit the passage of a game piece 115 into storage chamber 405 (discussed in greater detail below). It should be understood that a variety of alternative configurations of the opening 335 (e.g., generally triangular, rectangular, rhomboid, etc.) and any number of radial cuts (e.g., three, five, six, etc.) would be within the spirit and scope of the present invention.

Figure 4A:
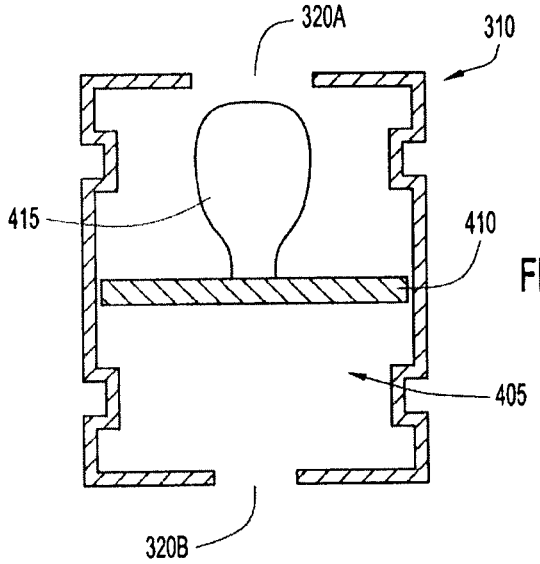
FIGS. 4A and 4B illustrate cross sectional views of the head of the collection device, showing the operation of the indicator as the head fills with game pieces.
Figure 4B:
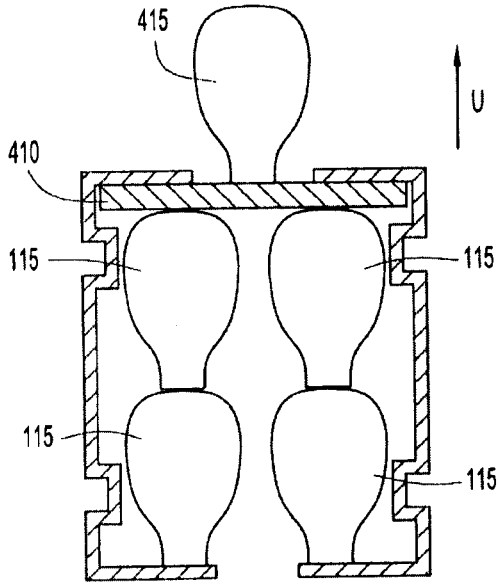

The indicator mechanism 315 is configured to indicate when a predetermined number of game pieces 115 is present within the storage chamber 405. In an embodiment, the indicator mechanism 315 is a mechanical indicator mechanism. Referring to FIGS. 4A and 4B, in the illustrated embodiment, the indicator mechanism 315 includes a base 410 and protruding member 415. The base 410 includes dimensions that correspond to the inner dimensions of the head portion 310 (i.e., of the storage chamber 405). By way of example, the base 410 may be in the form of a generally circular disc. In another embodiment, the base may in the form of an inverted cup. The protruding member 415 may be in the form of a figurine attractive to a user of the device. By way of example, the figured may be stylized as an animal, a cartoon character, etc. The figurine may include and shape and dimensions suitable for its intended purpose. In a preferred embodiment, the figuring is sized such that, when the base 410 in its lowered (normal) position, the figurine is recessed within the head portion 310, but when the base is in its fully raised position, the entire figurine protrudes from the head portion (and thus is viewable by a user of the collection device 110).

The base 410 is configured to move axially within the storage chamber 405. In one embodiment, the base 410 includes a pair of diametrically opposed, radially-extending tabs that each slidingly engages a corresponding guide track. The guide tracks are disposed at predetermined radial positions along the inner wall of the storage chamber 405. The tracks are configured to guide the base 410 axially within the chamber 405 from a first, lowered or normal position (FIG. 4A) to a second or raised position (FIG. 4B), indicated by arrow "U." In the first position, the protruding member 415 is housed completely within the storage chamber 405 and not generally visible to a viewer. In the raised position, however, the base 410 is oriented proximate the first side 320A of the head portion 310 such that the protruding member 415 extends out from first side opening, becoming fully visible to a viewer.

The base 410, moreover, is in communication with the area of the storage chamber 405 in which the game pieces 115 are collected. As a result, when the storage chamber 405 is empty, the indicator mechanism 315 is disposed in its first (lowered) position. When the storage chamber 405 is filled, however, the indicator mechanism 315 is raised to its second (raised) position. The amount of extension out of the head portion 310 depends on the amount of game pieces 115 present within the chamber 405.

Figure 5A:
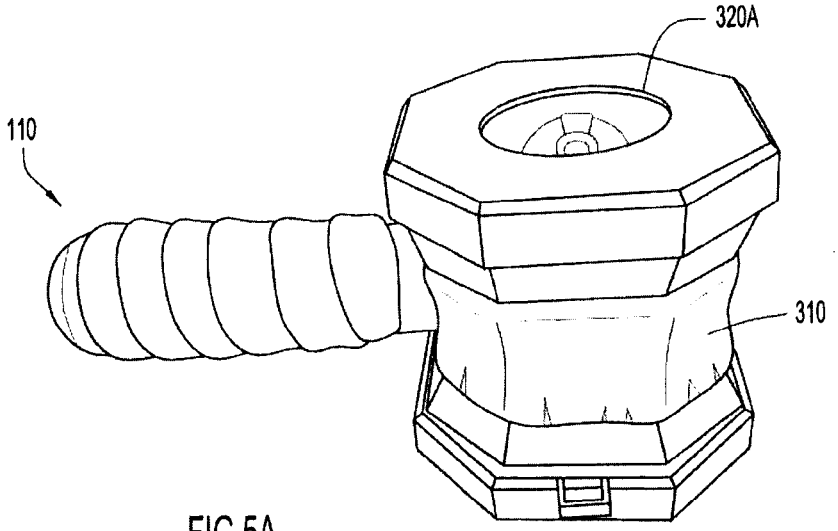
FIGS. 5A and 5B illustrate perspective views of the collection device, showing the indicator in positions that indicate an empty chamber (FIG. 5A) and a full chamber (FIG. 5B).

The operation of the collection device 110 and the indicator mechanism 315 is further explained with reference to FIGS. 4A, 4B, 5A, and 5B. In FIGS. 4A and 5A, the collection device 110 is empty, and the base 410 is oriented in its normal, lowermost position. In addition, the protruding member 415 is oriented in its retracted position such that it is not visible to a user of the device. A player collects game pieces 115 (e.g., by striking downward on each game piece lying on the playing surface). The striking force is sufficient to urge the game piece 115 through the membrane 330 and into the storage chamber 405. Once disposed within the storage chamber 405, the game piece 115 is captured—other forces applied during game play are insufficient to urge the game piece out of the storage chamber.

Figure 5B:
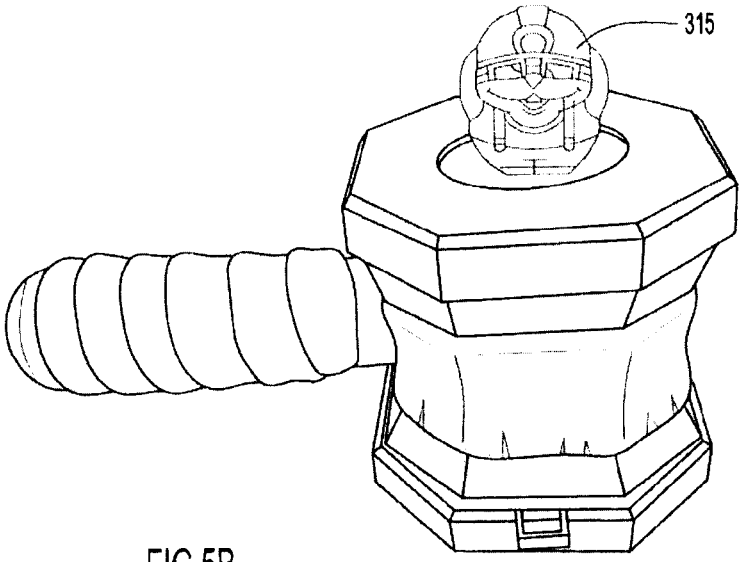

Referring to FIGS. 4B and 5B, as the game pieces 115 are collected, the storage chamber 405 becomes filled with game pieces. Individual game pieces 115 become stacked within the chamber 405, contacting the base 410 and driving it upward. The internal dimensions of the storage chamber 405 and the lift distance of the indicator 315 are configured such that, once a predetermined number of game pieces 115 is present within the chamber, the base 410 of the indicator mechanism 315 is lifted from its first position to its second position. In the second position, the protruding member 415 is fully visible to a user, thereby indicating that the predetermined amount of game pieces 115 has been collected. Once the predetermined number of game pieces 115 has been collected, a winner may be declared (e.g., collecting about six game pieces may be sufficient to win a match in one exemplary method of game play).

Figure 6:
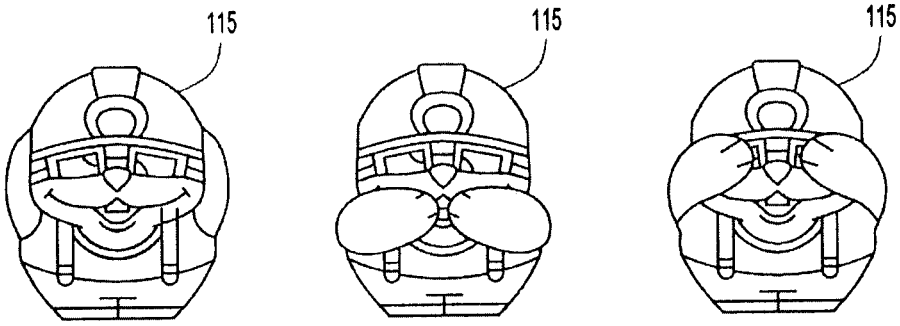
FIG. 6 illustrates a front view of game pieces in accordance with an embodiment of the present invention.

With reference to FIG. 6, the game pieces 115 may be stylized as figures having an entertaining appearance. The game pieces are of a general size and shape to be admitted within the opening 335 of the membrane 330, yet not so large as to fall out of the opening during capture of additional pieces. In operating another embodiment of the action game, game pieces may be colored, numbered or otherwise designated for enhanced game play. As an example, blue game pieces may count for two points, red game pieces may count for three points, and so on. In yet another embodiment, colored or numbered game pieces may be assigned to specific game players. For example, "Player 2" may be required to capture all game pieces with the number "two," and capturing incorrect game pieces would lessen or eliminate his/her chances of winning the game.

An embodiment of the game play associated with the action game 10 is as follows. A plurality of game pieces 115 is placed in the cavity 210 (on the floor 215). The players use their respective collection devices 110 to strike the paddle portion 230 of a corresponding engagement member 225. Since the paddle portion 230 is in pivoting communication with the propelling member 220 (through the pivot pins 240 and trigger arm 235), the propelling member is driven upward, thrusting one or more game pieces 115 out of the cavity 210 and arbitrarily scattering the game pieces 115 about a supporting surface, such as a floor or a table. As noted above, the engagement members 225 may be configured such that a stronger strike on the paddle portion 230 may lead to greater thrusting by the propelling member.

Once the game pieces 115 are disposed on the playing surface, each player attempts to capture the game pieces by striking the head portion 310 of the collection device 110 upon the game pieces (the second side 320B of the head portion including the membrane 330 should face the game piece). The membrane 330 on the head portion 310 accepts and retains the game pieces 115 within the storage chamber 405 as described above. Once a set number of game pieces 115 is captured by a player, the indicator mechanism 315 is fully engaged as described above, signaling a winner. To remove the game pieces 115 from the storage chamber 405, the membrane 330 is removed and the contents of the chamber expelled.

The above describe invention combines aspects of game play which are very exciting and stimulating to children and adults alike. The striking of the paddles is thrilling to the sensors and combines finite motor skills with hand-eye coordination. This action is further enhanced by the visual parade of game pieces being thrown into the air, where game players may follow game pieces mid-air to get a head start on capturing game pieces. Finally, the action continues, when a player again strike the game pieces with the capturing device, as quickly as possible, to win the game. Finally, the game is enhanced by an indicator that keeps track of game pieces captured by each player and reveals a winner upon capture of a predetermined number of game pieces. The indicator is pivotal, as it allows for quick paced fun without having to calculate and/or remember how many game pieces each player has captured. The use of developmental skills combined with fast-paced action makes this game ideal for children and adults alike.

It is believed that the disclosure set forth above encompasses multiple distinct inventions with independent utility. While each of these inventions has been disclosed in a preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where any description recites "a" or "a first" element or the equivalent thereof, such disclosure should be understood to include incorporation of one or more such elements, neither requiring nor excluding two or more such elements.

While the invention has been described in detail and with references to specific embodiments thereof, it will be apparent to one skilled in the art that various changes and modifications can be made therein without departing from the spirit and scope of the invention. For example, while a propelling member in the form of a boss 220 is illustrated, other propelling members may be utilized. By way of specific example, the boss may be omitted and the entire floor 215 may axially (vertically) articulate within the cavity 210.

In addition, the indicator mechanism 315 may be an electrical or mechanical indicator. The indicator mechanism 315 may include a visual indicator, an auditory indicator, a sensory indicator, a variation thereof, or combinations thereof. Furthermore, the indicator mechanism 315 may incorporate a light, a sound, a vibrating motor, an oscillator, a variation thereof, or combinations thereof. In one embodiment, the indicator mechanism 315 may be activated mechanically by a mechanism found in the head portion 310 of collection device 110. As an example, game pieces 115 are collected in the head portion 310 and, upon the accumulation of a predetermined number of game pieces, a spring mechanism is triggered, releasing the indicator mechanism 315 and revealing the game winner.

In other embodiments, the indicator mechanism 315 may be activated by a compression device, wherein the indicator is situated within the head portion 310 and above the second side opening 320B. For each game piece 115 captured within the head portion 310, the indicator 315 is moved upwards, and upon the capture of a predetermined number of game pieces 115, the indicator is exposed through the first opening 320A of the head portion, revealing a game winner. In yet another embodiment, the indicator mechanism 315 may be activated by an electronic mechanism. As an example, an electronic mechanism may incorporate the use of an electronic recognition device coupled to the first side 320A or second side 320B opening of the head portion 310, with the collection device 110 operable to recognize and tally the number of game pieces 115 entering the chamber 405 (e.g., counting each game piece as it passes through opening of second side 320B), and revealing the indicator 315 once a predetermined number of game pieces 115 have been captured.

Figure 7:
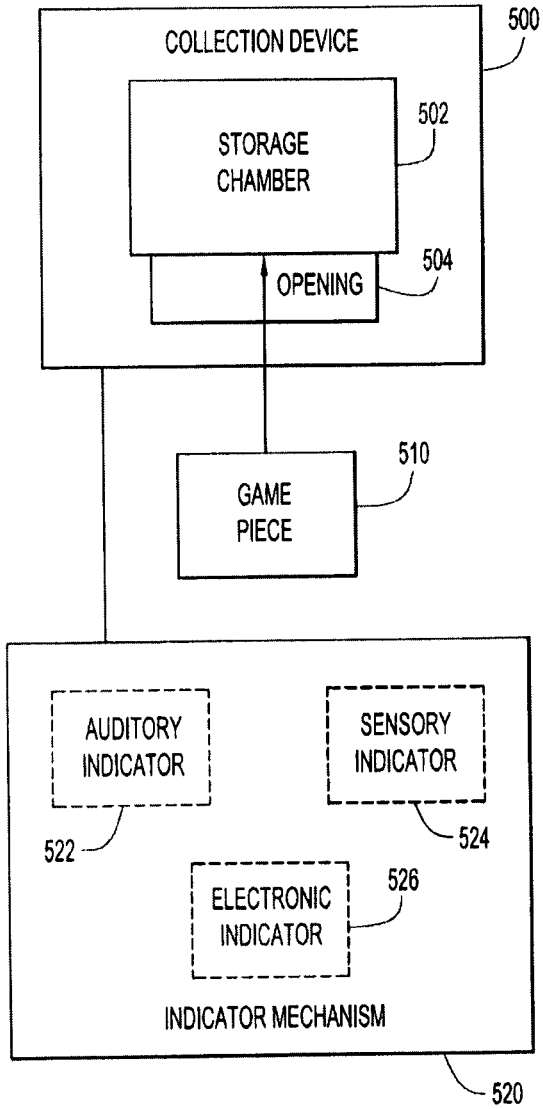
FIG. 7 illustrates a schematic block diagram of a collection device in accordance with another embodiment of the present invention.

Referring to FIG. 7, a schematic view of an embodiment of a collection device according to the present invention is illustrated. As shown, the collection device 500 includes a storage chamber 502 and an opening 504 in communication with the storage chamber 502. Game pieces 510 can be inserted into the storage chamber 502 via the opening 504, as discussed above.

The collection device 500 includes an indicator mechanism 520 that provides an indication when a certain quantity of game pieces 510 is in the storage chamber 502. The indicator mechanism 315 discussed above functions as a visual indicator, a sensory indicator, and/or as a mechanical indicator. As shown in FIG. 7, the indicator mechanism 520 can have one or more types of indicators as well. The indicator may be an auditory indicator 522, such as an audible output that can be heard by a player. The collection device 500 would have a speaker or transducer that could be used to generate the audible output (sound effects, music, speech, or other output). The indicator may be a sensory indicator 524 that can be perceived by any of the senses of a player. Alternatively, the indicator may be an electronic indicator 526 that is generated by an electronic system, and may include LEDs or other light outputting device.

Thus, it is intended that the present invention covers the modifications and variations of this invention provided they come within the scope of the appended claims and their equivalents. For example, the majority of the elements can be formed of molded plastic. However, in alternative embodiments, the elements can be formed of a material other than plastic provided that the material has sufficient strength for the component's intended function.

What is claimed is:

1. An action game apparatus, comprising:
- a game piece;
- a collection device comprising:
  - a body defining a storage chamber operable to store the game piece and defining an opening for accepting a game piece, and
  - an indicator mechanism operable to indicate when a predetermined number of game pieces is present within the storage chamber; and
- a launching device comprising:
  - a body defining a recessed cavity,
  - an articulating member disposed within the recessed cavity, and
  - a pivoting lever in communication with the articulating member.

2. The action game apparatus of claim 1, wherein the indicator mechanism is an electronic indicator.

3. The action game apparatus of claim 1, wherein the indicator mechanism is a mechanical indicator.

4. The action game apparatus of claim 1, wherein the indicator mechanism is a visual indicator.

5. The action game apparatus of claim 1, wherein the indicator mechanism is an auditory indicator.

6. The action game apparatus claim 1, wherein the indicator mechanism is a sensory indicator.

7. The action game apparatus of claim 1, further comprising:
- a plurality of game pieces, each game piece including a varying designation selected from the group consisting of color, number, shape, sound, and combinations thereof.

8. The action game apparatus of claim 1, wherein the indicator mechanism includes a telescoping indicator operable to extend out of and retract into the collection device body; and the indicator extends to a predetermined extension position to indicate when the predetermined number of game pieces is present within the storage chamber.

9. The action game apparatus of claim 8, wherein the indicator comprises a base and a protruding member extending distally from the base.

10. The action game apparatus of claim 8, wherein the indicator moves axially within the storage chamber from a first indicator position, in which the indicator is housed within the storage chamber, to a second storage device, in which at least a portion of the indicator protrudes out from the storage chamber.

11. An action game apparatus, comprising:
- a game piece;
- a launching device comprising:
  - a body defining a cavity operable to receive a plurality of game pieces,
  - a propulsion mechanism operable to propel a game piece out of the cavity, the propulsion mechanism comprising:
    - a propelling member disposed within the cavity; and
    - an engagement member in communication with the propelling member such that engaging the engagement member drives the propelling member from a first propelling member position to a second propelling member position; and
- a collection device comprising:
  - a body defining a storage chamber operable to store the game piece and a body opening for accepting a game piece, and
  - an indicator operable to indicate when a predetermined number of game pieces is present within the storage chamber.

12. The action game apparatus of claim 11, wherein the indicator is a telescoping indicator operable to extend out of and retract into the collection device body; and the indicator extends to a predetermined extension position to indicate when the predetermined number of game pieces is present within the storage chamber.

13. The action game apparatus of claim 11, further comprising:
- a membrane coupled to the collection device body opening, the membrane comprising a plurality of flexible tabs that cooperate to selectively permit the passage of the game pieces through the collection device body opening.

14. The action game apparatus of claim 11, wherein the indicator comprises a base and a protruding member extending distally from the base.

15. The action game apparatus of claim 11, wherein the indicator moves axially within the storage chamber from a first indicator position, in which the indicator is housed within the cavity, to a second storage device, in which at least a portion of the indicator protrudes out from the collection device.

* * * * *